United States Patent [19]

Blake

[11] 4,278,246

[45] Jul. 14, 1981

[54] CLAMPING DEVICE

[76] Inventor: John B. Blake, 103 Oak Ave., Park Ridge, N.J. 07656

[21] Appl. No.: 103,185

[22] Filed: Dec. 13, 1979

[51] Int. Cl.[3] ..... B25B 1/10

[52] U.S. Cl. ..... 269/220; 269/237; 269/242

[58] Field of Search ..... 269/242, 219–220, 269/237; 254/100

[56] References Cited

U.S. PATENT DOCUMENTS

| | | | |
|---|---|---|---|
| 1,716,718 | 6/1929 | Castagna | 269/242 X |
| 2,530,203 | 11/1950 | Lear | 269/220 X |

FOREIGN PATENT DOCUMENTS

| | | | |
|---|---|---|---|
| 6235 | 1/1979 | German Democratic Rep. | 269/220 |

*Primary Examiner*—Robert C. Watson
*Attorney, Agent, or Firm*—Robert A. Maikis

[57] ABSTRACT

A clamping device is provided having a pair of outwardly curved arms with pivotally mounted clamping jaws at one end thereof. A rotatable leverage screw threadedly engages pivot members which are pivotally mounted at the other end of the arms. A rotatable fulcrum screw threadedly engages pivot members which are pivotally mounted on the arms intermediate the ends thereof, so that rotation of the fulcrum screw causes the arms to rotate about the pivot members associated with the leverage screw to open and close the jaws at a suitably high speed and rotation of the leverage screw causes the arms to rotate about the pivot members associated with the fulcrum screw to open and close the jaws with the force required to obtain a good clamping action. A pair of telescoping support members which permit relative lateral movement between the fulcrum and leverage screws and prevent relative axial movement between the same screws are mounted on the fulcrum and leverage screws to limit skewing of the arms when the jaws are open.

11 Claims, 7 Drawing Figures

FIG. 1
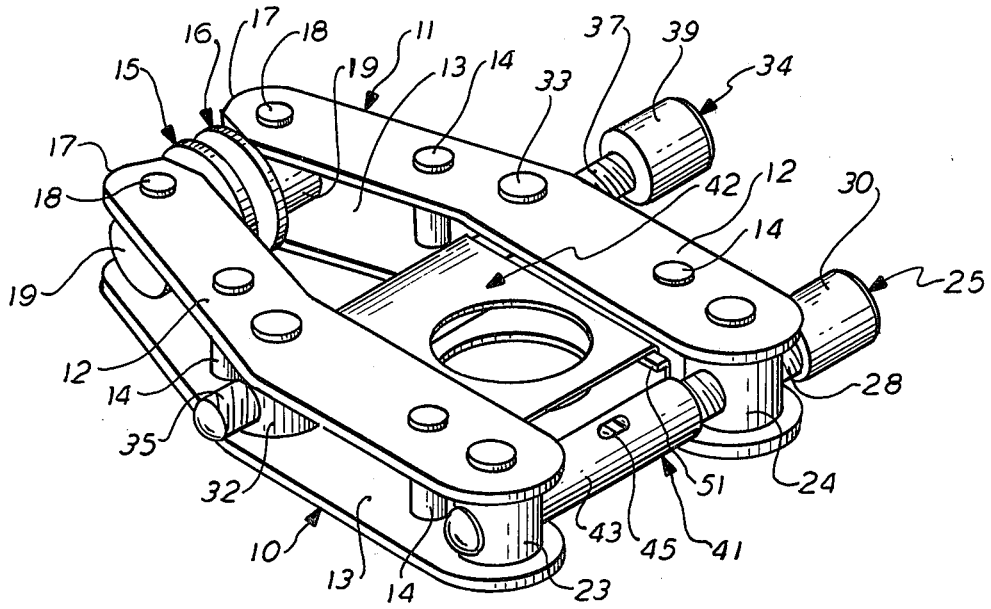
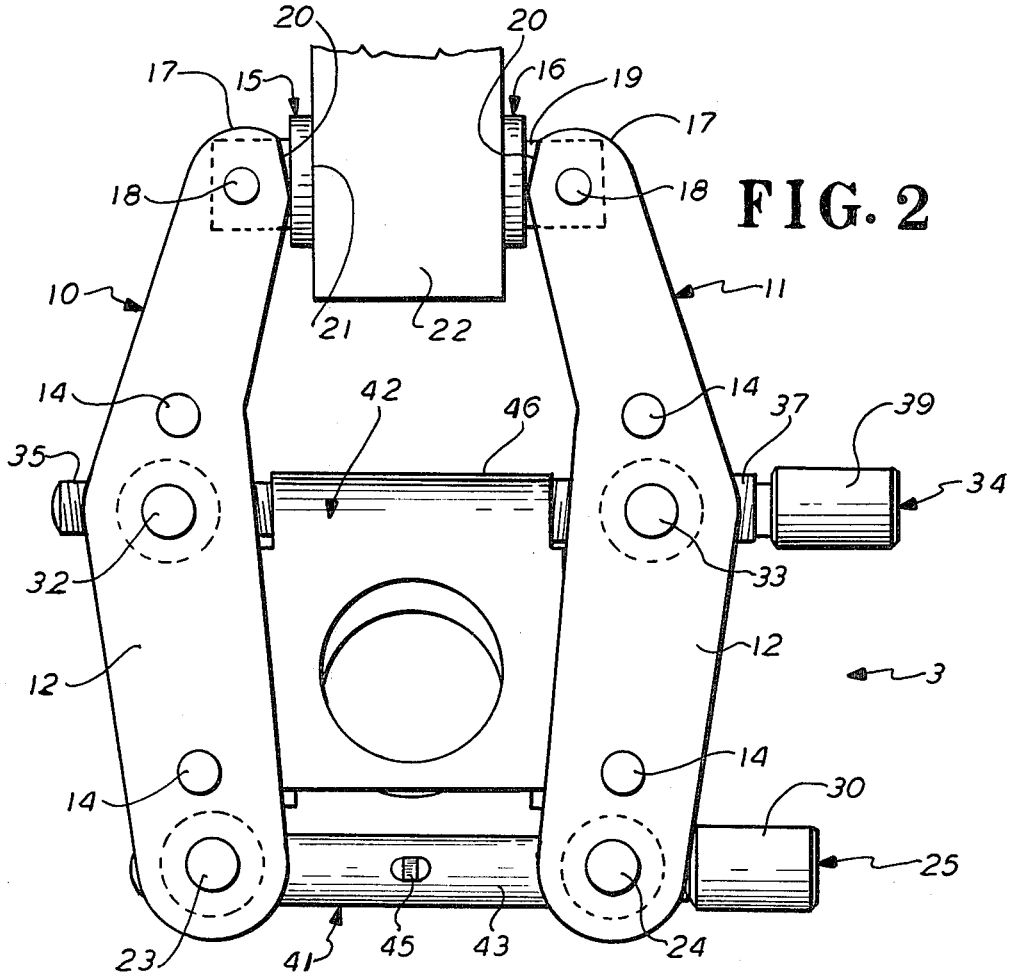
FIG. 2

FIG. 3
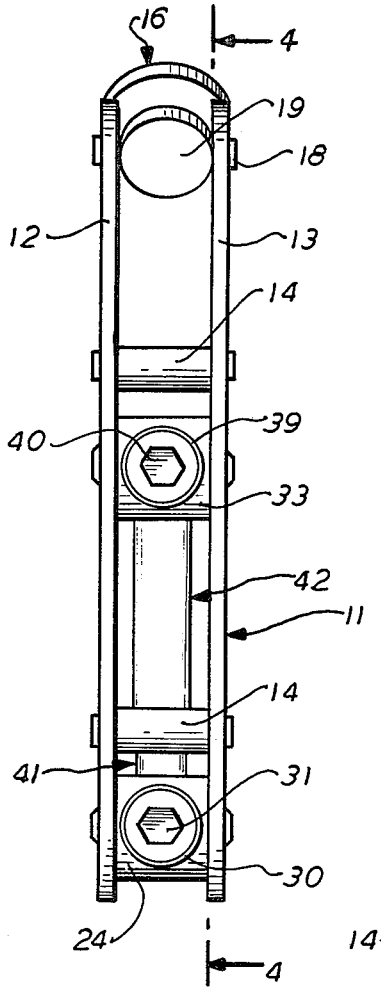
FIG. 5
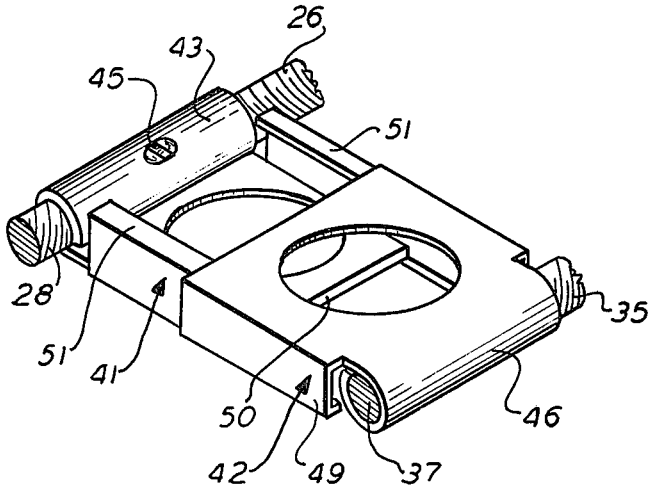
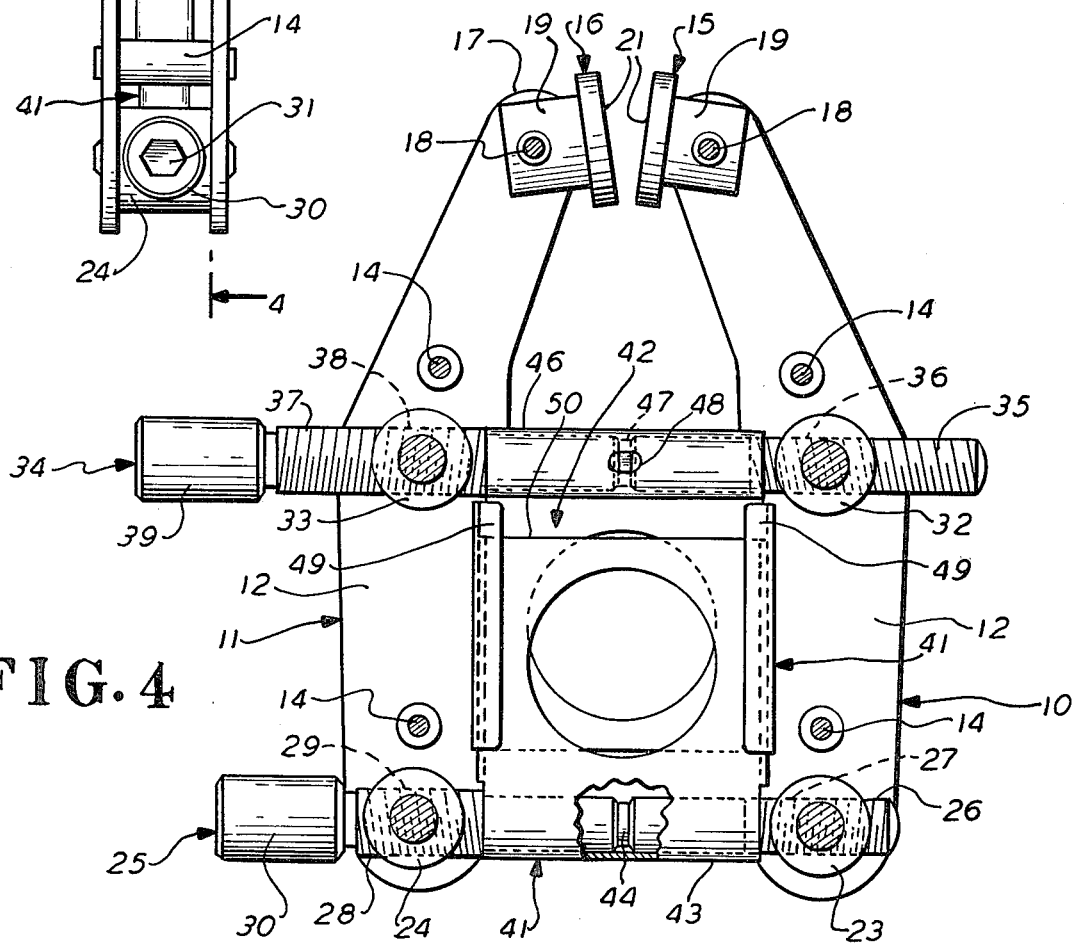
FIG. 4

CLAMPING DEVICE

BACKGROUND OF THE INVENTION

1. Field of the Invention

This invention relates to clamping devices and more particularly to a hand clamp of novel construction having improved operating characteristics.

2. Description of the Prior Art

Among the widely used clamps on the market at the present time is the so-called "C" clamp. This clamp usually has a relatively slow operating speed because a single screw is employed to open and close the jaws of the clamp with the result that a compromise must be made in selecting the pitch of the screw thread to provide both the required mechanical clamping force and operating speed. The "C" clamp also has a tendency to twist the work when flat, hard pieces are clamped together and requires a substantial operating force to tighten the clamp because of the frictional engagement of the end of the screw with the socket of the movable jaw which is pivotally mounted on the screw. This clamp may also be unsuitable for use in many applications where space is limited because of its relatively large length. For example, regulations adopted under the Federal "Occupational Safety and Health Act" mandate the use of plastic or cage type safety guards in certain types of industrial operations. The physical size of the required guard will therefore often be a limiting factor when deciding the type of clamp to be used in a particular operation.

The toolmakers parallel clamp, which has a pair of flat parallel jaws operated by two parallel screws, eliminates many of the problems of the "C" clamp, such as twisting of the work, for example. However, this type of clamp is suitable for use only with flat, hard work pieces because of the necessity of keeping the jaws in a parallel relationship to secure a satisfactory clamping action. Another type of clamp which eliminates twisting of the work has first and second bent arms having jaws pivotally mounted at one end thereof. The other end of the first arm is pivotally mounted on the second arm at a point intermediate the ends thereof and the other end of the second arm is pivotally connected to the apex or elbow which is intermediate the ends of the first arm by means of a single screw, so that twisting of the work is eliminated. However, the socket mounting of the end of the single screw produces frictional loss and the mechanical configuration of the arms produces an operating speed for the jaws which is relatively slow when the jaws are wide open and which gets progressively faster as the jaws are closed, which is the reverse of the operating speed characteristic usually desired.

SUMMARY OF THE INVENTION

It is an object of this invention to provide a clamping device which is compact in size and which is ideally suited for applications having a limited working space.

It is a further object of this invention to provide a clamping device which will not twist flat, hard work pieces and which does not utilize a socket mounting for the screws of the clamp, so that the frictional loss involved in such mounting is eliminated.

It is still a further object of this invention to provide a clamping device having an operating speed characteristic which permits fast opening and closing of the jaws and also permits the clamp to be tightened with a high clamping force at a relatively low speed of jaw closure.

It is another object of this invention to provide a clamping device which may be used to correct warped work pieces and which may be used with work pieces which are not flat and hard.

Briefly, the clamping device of the invention comprises first and second oppositely-disposed arms having a pair of oppositely-disposed clamping jaws at one end thereof. First and second force applying means are provided for moving the arms towards and away from each other. The first force applying means is pivotally connected to the arms at first pivot points which are spaced a distance from the one end of the arms, so that the clamping jaws are adapted to open and close when the arms are rotated about the first pivot points. The second force applying means is pivotally connected to the arms at second pivot points which are disposed intermediate the first pivot points and the one end of the arms, so that the clamping jaws are also adapted to open and close when the arms are rotated about the second pivot points. This configuration permits the first force applying means to open and close the jaws by rotating the arms about the second pivot points and the second force applying means to open and close the jaws by rotating the arms about the first pivot points. Slideable support means interconnecting the first and second force applying means are provided to permit relative lateral movement between the first and second force applying means and to prevent relative axial movement between the first and second force applying means, to thereby limit skewing of the arms when the jaws are open.

The nature of the invention and other objects and additional advantages thereof will be more readily understood by those skilled in the art after consideration of the following detailed description taken in conjunction with the accompanying drawings.

BRIEF DESCRIPTION OF THE DRAWINGS

In the drawings:

FIG. 1 is a top perspective view of the clamping device of the invention;

FIG. 2 is a top plan view of the clamp of FIG. 1 with a work piece between the clamping jaws;

FIG. 3 is a side elevational view of the clamp taken in the direction of the arrow 3 in FIG. 2 of the drawings;

FIG. 4 is a full sectional view of the clamp taken along the line 4—4 of FIG. 3 of the drawings with a portion of the slideable support means broken away to reveal details of construction of the leverage screw;

FIG. 5 is a perspective view of the slideable support means of the clamp showing fragments of the leverage and fulcrum screws;

DESCRIPTION OF THE PREFERRED EMBODIMENT OF THE INVENTION

Figure 6:
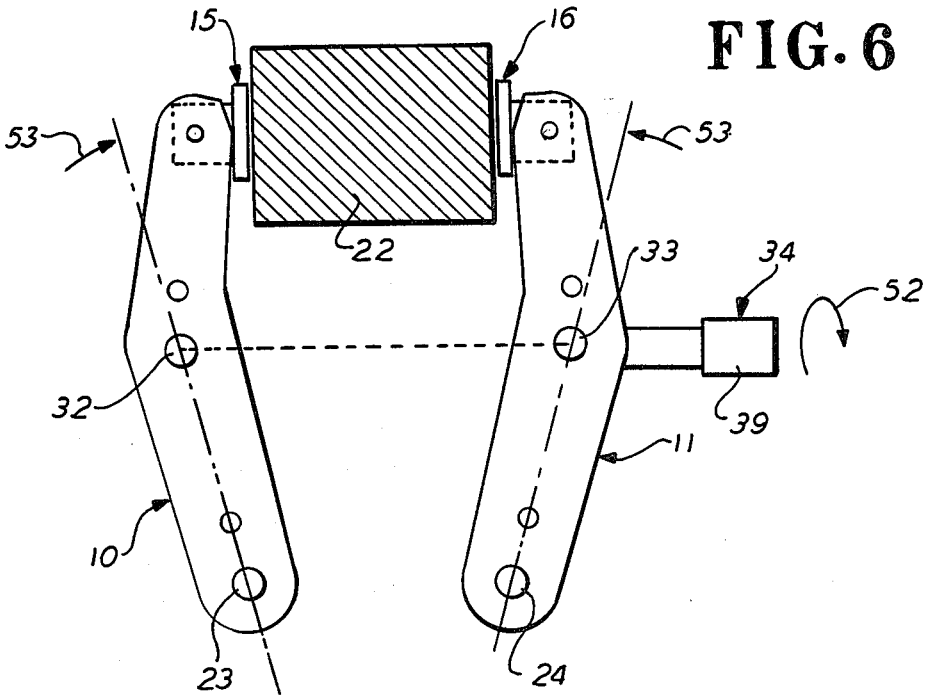
FIG. 6 is a schematic top plan view of the clamp showing the pivotal movement of the arms when the fulcrum screw is tightened.

Referring now to FIG. 1 of the drawings, there is shown a clamping device constructed in accordance with the teachings of the present invention comprising a first outwardly curved or bent arm, indicated generally as 10, and an oppositely-disposed, second outwardly curved or bent arm, indicated generally as 11. Each of the arms 10 and 11 comprises a pair of outwardly curved arm plates 12 and 13 which are connected together by rivets 14 in a spaced apart relationship to form an open-sided frame. A pair of oppositely-disposed clamping jaws, indicated generally as 15 and 16, are pivotally mounted at one end 17 of the arms by means of trunnions or lugs 18 which project from the shanks 19 of the jaws and are seated in openings formed in the arm plates 12 and 13. It will be noted that the rounded ends 17 of the arms plates 12 and 13 are provided with a relatively straight or flat section 20 which defines abrupt changes in curvature or peaks at the ends of the flat sections 20 which serve to limit the angular rotation of the clamping jaws to a predetermined angle of rotation. This arrangement prevents the clamping jaws from being rotated into such an angular position when the clamp is open that the faces 21 of the jaws will not be able to engage a work piece 22 when the clamp is closed as shown in FIG. 2 of the drawings.

The clamp is provided with first force applying means comprising a first pivot member 23 which is pivotally mounted at the other end of arm 10 between the arm plates 12 and 13, a second pivot member 24 which is pivotally mounted at the other end of arm 11 between the arm plates 12 and 13, and a rotatable leverage screw or shaft, indicated generally as 25. As seen in FIG. 4 of the drawings, the rotatable shaft 25 has a first externally threaded section 26 which engages an internally threaded bore 27 in pivot member 23 and a second externally threaded section 28 which engages an internally threaded bore 29 in pivot member 24. The internally threaded bores 27 and 29 of the pivot members 23 and 24 respectively have different thread directions, so that as the leverage screw or shaft 25 is rotated, both of the arms 10 and 11 will move towards or away from each other depending upon the direction of rotation of the shaft 25. Since the first force applying means is pivotally connected to the arms 10 and 11 at pivot points defined by the pivot members 23 and 24, it will be seen that the clamping jaws 15 and 16 will open and close when the arms are rotated about these pivot points. A knurled head 30 is provided at one end of the leverage screw 25 to permit the shaft to be manually rotated and a hexagonal opening 31, which is adapted to receive an Allen wrench, is provided in the head 30, as shown in FIG. 3 of the drawings, to permit a greater leverage to be applied if desired.

The clamp is also provided with a second force applying means comprising a first pivot member 32 which is pivotally mounted on the arm 10 intermediate the ends of that arm between the arm plates 12 and 13, a second pivot member 33 which is pivotally mounted on arm 11 intermediate the ends of the arm between the arm plates 12 and 13 thereof, and a rotatable fulcrum screw or shaft, indicated generally as 34. The shaft 34 has a first externally threaded section 35 which engages an internally threaded bore 36 extending through pivot member 32 and a second externally threaded section 37 which engages an internally threaded bore 38 extending through pivot member 33. The shaft 34 is provided with a knurled head 39 having a hexagonal opening 40 as seen in FIG. 3 of the drawings, so that the shaft 34 may be tightened by finger rotation or by an Allen wrench. The internally threaded bores 36 and 38 of the pivot members 32 and 33 respectively are provided with different thread directions, so that both of the arms 10 and 11 will be moved towards or away from each other depending upon the direction of rotation of the shaft 34.

As seen in FIGS. 1, 2, 4 and 5 of the drawings, the clamp is provided with slideable support means comprising a first support member, indicated generally as 41, which is mounted on the rotatable shaft 25 of the first force applying means between the pivot members 23 and 24 thereof and a second support member, indicated generally as 42, which is mounted on the rotatable shaft 34 of the second force applying means between the pivot members 32 and 33 thereof. The support member 41 comprises a support plate having one end 43 thereof bent or curved back on itself, as shown in FIG. 5 of the drawings, to form a passageway along that end in which the rotatable shaft 25 is disposed. The passageway is so proportioned with respect to the shaft as to provide a running or sliding fit, so that the shaft 25 may be freely turned in the support plate 41. As seen in FIG. 4, the rotatable shaft 25 which functions as the leverage screw of the clamp is provided with a reduced diameter portion or neck 44 which is disposed between the first and second threaded sections of the shaft. As seen in FIG. 5, the end 43 of the support plate 41 has an inwardly projecting portion 45 of the passageway which is seated in the reduced diameter shaft portion 44. The reduced diameter portion 44 of the shaft and the inwardly extending portion 45 of the support plate cooperate with each other and function as detent means to prevent relative axial movement between the support member 41 and the rotatable shaft 25 on which the support member is mounted. In a similar fashion, the support plate 42 is provided with a passageway at the end 46 thereof which slideably engages the rotatable shaft 34 of the second force applying means. As seen in FIG. 4 of the drawings, the shaft 34 has a reduced diameter portion 47 which cooperates with an inwardly projecting portion 48 of the passageway in support member 42 to form detent means which prevent relative axial movement between the support member 42 and the fulcrum shaft 34.

As seen in FIGS. 4 and 5 of the drawings, support plate 42 is provided with reentrant flanges 49 along the sides thereof which form a pocket frame in which the other end 50 of the support plate 41 is slideably disposed in a telescoping relationship. The support plate 41 is provided with similar reentrant flanges 51 along its sides so that the support plate 41 is received by the support plate 42 with a sliding, telescoping fit which permits relative lateral movement between the support members 41 and 42 along a path which is substantially perpendicular to the axes of rotation of the fulcrum and leverage screws but prevents relative axial movement therebetween along a path which is substantially parallel to the axes of rotation of the fulcrum and leverage screws. If desired, the reentrant flanges 51 on the support member 41 may be omitted and the reentrant flanges 49 on the member 42 so proportioned that the same sliding fit is obtained between the support plates when they are telescoped. By virtue of this arrangement, it is seen that the slideable support means formed by the support members 41 and 42 permits the rotatable shafts 25 and 34 to have relative lateral movement therebetween because of the telescoping action of the slideable support means. At the same time, the shafts 25 and 34 are prevented from having relative axial movement therebetween because they are held in essentially fixed axial positions with respect to the slideable support plates 41 and 42 by the detent means at the ends 43 and 46 of the support plates.

Figure 7:
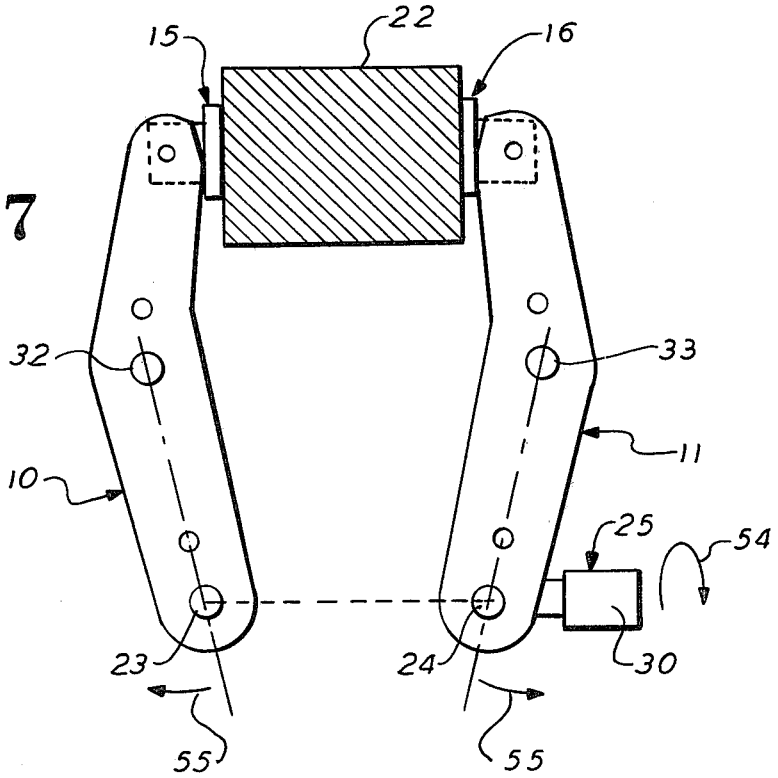
FIG. 7 is a schematic top plan view of the clamp showing the pivotal movement of the arms when the leverage screw is tightened.

The operation of the clamping device of the invention will now be described with reference to FIGS. 4, 6 and 7 of the drawings. As hereinbefore explained, the fulcrum screw 34 is axially fixed in position with respect to the slideable support means 41, 42, so that as the fulcrum screw is rotated, the threaded sections 35 and 37, which have opposite thread directions, engage the threaded bores of pivot members 32 and 33 respectively to cause the arms 10 and 11 to pivot about the pivot members 23 and 24 respectively to thereby open or close the clamping jaws 15 and 16. When the threaded shaft section 35 is provided with a right hand thread and the shaft section 37 is provided with a left hand thread, as illustrated, a clockwise rotation of the fulcrum screw 34 in the direction of the arrow 52 shown in FIG. 6 of the drawings will cause the arms to rotate about the pivot members 23 and 24 in the direction of the arrows 53 to close the jaws. After the work piece 22 is loosely clamped in position between the jaws by a finger tight rotation of the fulcrum screw 34, the leverage screw 25 is employed to tighten the clamp and apply maximum clamping force to the work piece. As the leverage screw 25 is rotated, its threaded shaft sections 26 and 28, which have opposite thread directions, engage the internally threaded bores of pivot members 23 and 24 respectively to cause the arms 10 and 11 to rotate about the pivot members 32 and 33 respectively, so that the clamping jaws will either open or close depending upon the direction of rotation of the shaft 25. When the shaft section 26 is provided with a left hand thread and the shaft section 28 is provided with a right hand thread, as illustrated, a clockwise rotation of the leverage screw 25 in the direction of the arrow 54 shown in FIG. 7 of the drawings causes the ends of the arms to which the leverage screw is connected to move outwardly away from each other in the direction of the arrows 55, so that the arms pivot about the pivot members 32 and 33 and close the clamping jaws to securely clamp the work piece in position.

When the fulcrum screw 34 is employed to close the clamping jaws, the clamping force which is applied to the work piece 22 will be relatively small but the opening and closing speeds of the jaws will be relatively high because the arms are pivoting about the pivot members 23 and 24 so that the length of the lever arm between the jaws and the pivot points 23, 24 is substantially greater than the length of the lever arm between the pivot points 23, 24 and the points at which the force is applied by the fulcrum screw. When the leverage screw 25 is employed to tighten the clamp, the clamping force which is applied to the work piece will be relatively high and the opening and closing speed of the jaws will be relatively low because the arms 10 and 11 are pivoting about the pivot points 32 and 33 which are intermediate the ends of the arms, so that the length of the mechanical lever between the pivot points 32, 33 and the jaws 15, 16 is of the same order of magnitude as the length of the lever between the pivot points 32, 33 and the ends of the arms to which the leverage screw is connected. Accordingly, because of the unique two screw configuration of the clamp, the mechanical advantage or leverage is much greater when the leverage screw is employed to tighten the clamp than when the fulcrum screw is employed to tighten the clamp. Similarly, the operating speed is much greater when the fulcrum screw is used to operate the clamp than when the leverage screw is employed. Both of the aforesaid advantages result from the unique construction of the clamp rather than from the pitch of the screw threads employed.

When the clamping jaws are open and there is no work piece in the clamp, it will be seen that the arms 10 and 11 may tend to skew out of an oppositely-disposed alignment because the arms are joined together only by the four pivot points defined by the pivot members 23, 24, 32 and 33. The slideable support means formed by the telescoping support members 41 and 42 serves to prevent such skewing of the arms by preventing the fulcrum screw and the leverage screw from moving axially with respect to each other. The slideable support means, however, must permit relative lateral movement between the fulcrum screw and the leverage screw because it will be seen that as the fulcrum screw is rotated, the pivot members 32 and 33 follow circular paths about the pivot points 23 and 24 so that as the clamping jaws are opened more and more the lateral distance between the fulcrum screw and the clamping screw becomes less and less. The same relative lateral movement between the fulcrum and leverage screws occurs when the leverage screw is being rotated.

When fabricating the clamp, the arm plates 12 and 13, clamping jaws 15 and 16, and the fulcrum and leverage screws are preferably made of a high tensile strength steel having some flexibility which will produce a good, tight clamping action. Since the slideable support means formed by the support members 41 and 42 perform no load bearing function when the clamp jaws are closed and only function to prevent the arms from skewing when the jaws are open, the support members may be formed of a much lighter gauge steel than the steel employed in the arm plates 12 and 13. The thread employed on the shaft sections 35 and 37 of the fulcrum screw may have a much coarser pitch than the thread employed on the shaft sections of the leverage screw to thereby further increase the opening and closing speeds of the jaws when the fulcrum screw is rotated. This is possible because with the unique construction of the clamp, the fulcrum screw need only be tightened "finger-tight" to hold the work in position until the desired large clamping force is applied by the leverage screw. Accordingly, when selecting the pitch of the threads for the fulcrum and leverage screws no compromise need be made between operating speed and clamping force. During assembly of the clamp, if it is desired to use "one-piece" fulcrum and leverage screws having heads which are integral with the body of the screws, the threaded shaft sections 35 and 26 which are farthest away from the screw heads should have a smaller diameter than the threaded shaft sections 37 and 28 which are closest to the head, so that the screws may be assembled with their respective threaded pivot members. Alternatively, the two threaded shaft sections of each screw may have the same diameter, in which case, the head of the screw must be separate from the body of the screw and be attached after assembly by means such as brazing, for example. When the fulcrum and leverage screws are inserted into the passageways formed at the ends of the telescoping support plates 41 and 42, the inwardly projecting portions 45 and 48 of the plates which seat in the reduced diameter portions 44 and 47 of the shafts may be conveniently formed by crimping.

It is believed apparent that many changes could be made in the construction and described uses of the foregoing clamping device and many seemingly different embodiments of the invention could be constructed without departing from the scope thereof. For example, the telescoping engagement of the slideable support means 41, 42 could be replaced by an arrangement wherein one of the support members was provided with an elongated laterally extending slot and the other of the members was provided with one or more pins or lugs which slideably engage the slot, so that the members could still slide laterally with respect to each other but could not be rotated or axially moved with respect to each other. Additionally, the disclosed two-plate or open-sided frame configuration of the arms 10 and 11 could be replaced by different arm structures having the same or different shapes. Accordingly, it is intended that all matter contained in the above disclosure or shown in the accompanying drawings shall be interpreted as illustrative and not in a limiting sense.

What is claimed is:

1. A clamp comprising first and second oppositely-disposed arms, said arms having a pair of oppositely-disposed clamping jaws at one end of the arms;

first and second force applying means for moving said arms towards and away from each other, said first force applying means being pivotally connected to said arms at first pivot points spaced a distance from said one end of the arms, so that said clamping jaws are adapted to open and close when said arms are rotated about said first pivot points, said second force applying means being pivotally connected to said arms at second pivot points disposed intermediate said first pivot points and said one end of the arms, so that said clamping jaws are also adapted to open and close when said arms are rotated about said second pivot points, whereby said first force applying means is adapted to open and close said jaws by rotating said arms about said second pivot points and said second force applying means is adapted to open and close said jaws by rotating said arms about said first pivot points; and slideable support means interconnecting said first and second force applying means to permit relative lateral movement therebetween and prevent relative axial movement therebetween, to thereby limit skewing of said arms when said jaws are open.

2. A clamp as claimed in claim 1 wherein said first pivot points are disposed at the other end of said arms.

3. A clamp as claimed in claim 1 wherein each of said first and second force applying means comprises first and second pivot members pivotally mounted on said first and second arms respectively at the pivot points associated with that force applying means, each of said pivot members having an internally threaded bore extending therethrough, said bores having different thread directions, and a rotatable shaft having first and second externally threaded sections engaging the threaded bores of said first and second pivot members respectively, said shaft sections having thread directions corresponding to the thread directions of said pivot member bores, so that rotation of said shaft in opposite directions opens and closes said clamping jaws.

4. A clamp as claimed in claim 1 wherein said clamping jaws are pivotally mounted at said one end of said arms.

5. A clamp as claimed in claim 3 wherein said slideable support means comprises first and second support members mounted on the rotatable shafts of said first and second force applying means respectively between the pivot members thereof, said first and second support members slideably engaging each other to permit relative lateral movement therebetween and prevent relative axial movement therebetween, and detent means for each of said support members for preventing relative axial movement between the support member and the rotatable shaft associated therewith.

6. A clamp as claimed in claim 5 wherein each of said first and second support members comprises a support plate having a passageway along one end thereof in which the rotatable shaft on which that support plate is mounted is disposed, at least one of said support plates having reentrant flanges along the sides thereof to form a pocket frame in which the other end of the other of said support plates is slideably disposed in a telescoping relationship.

7. A clamp as claimed in claim 6 wherein each of said detent means comprises a reduced diameter portion of the rotatable shaft associated therewith, said shaft portion being disposed between the first and second theaded sections of the shaft, and an inwardly projecting portion of the passageway at said one end of the support plate associated therewith, said passageway portion being seated in said reduced diameter shaft portion.

8. A clamp as claimed in claim 7 wherein each of said first and second arms comprises a pair of outwardly curved arm plates connected together in a spaced apart relationship to form an open-sided frame, the pivot members associated with each of said arms are mounted between the arm plates thereof, and said clamping jaws are pivotally mounted at said one end of said arms between the arm plates thereof.

9. A clamp as claimed in claim 8 wherein the rotatable shaft of each of said first and second force applying means has a head at one end thereof for rotating the shaft, the heads of both shafts being disposed exteriorly of the clamp on the same side thereof, and the bore of the first pivot member of the first force applying means has a different thread direction than the bore of the first pivot member of the second force applying means, so that the shaft head of the first force applying means may be rotated in the same direction as the shaft head of the second force applying means when opening and closing the clamping jaws.

10. A clamp as claimed in claim 9 wherein the shaft head of the shaft of each of said first and second force applying means is integral with the shaft, and the diameter of the shaft section closest to the head is greater than the diameter of the shaft section farthest from the head to facilitate assembly of the clamp.

11. A clamp as claimed in claim 9 wherein the threaded sections of the shaft of the second force applying means have a coarser pitch than the threaded sections of the shaft of the first force applying means to increase the speed with which the clamping jaws are opened and closed by said second force applying means.

* * * * *